United States Patent [19]

Doan

[11] 3,945,774

[45] Mar. 23, 1976

[54] ANCHORABLE PACK-OFF ASSEMBLY

[76] Inventor: John R. Doan, 305 W. Walnut St., Robinson, Ill. 62454

[22] Filed: Mar. 25, 1974

[21] Appl. No.: 454,312

[52] U.S. Cl. ..... 417/554
[51] Int. Cl.[2] ..... F04B 21/04
[58] Field of Search ..... 417/487, 554

[56] References Cited

UNITED STATES PATENTS

| | | | |
|---|---|---|---|
| 2,262,128 | 11/1941 | Zehner | 417/487 X |
| 2,817,298 | 12/1957 | Bloudoff | 417/554 |
| 3,479,958 | 11/1969 | Anderson et al. | 417/554 X |
| 3,646,846 | 3/1972 | Houghton | 277/230 X |

FOREIGN PATENTS OR APPLICATIONS

| | | | |
|---|---|---|---|
| 821,907 | 12/1937 | France | 417/554 |
| 13,877 | 6/1913 | United Kingdom | 277/236 |

*Primary Examiner*—C. J. Husar
*Assistant Examiner*—Leonard Smith
*Attorney, Agent, or Firm*—Hill, Gross, Simpson, Van Santen, Steadman, Chiara & Simpson

[57] ABSTRACT

A pack-off assembly provides a dual tubing dump for a well, for example an oil well, includes a pack-off assembly which forms, divides and fluidically seals upper and lower pumping chambers to provide essentially twice the ordinary fluid flow from a well.

7 Claims, 4 Drawing Figures

ANCHORABLE PACK-OFF ASSEMBLY

BACKGROUND OF THE INVENTION

1. Field of the Invention

This invention relates to pump apparatus, and is more particularly concerned with pumps which are integrally formed with the tubing of a well, in particular an oil well.

2. Description of the Prior Art

It is well known in the art to provide double displacement pumps, generally in the form of insert pumps; however, such pumps require a multitude of operating components for pumping a liquid, such as oil, from the bottom of the well to the surface.

SUMMARY OF THE INVENTION

The object of the present invention is to provide a new and improved well pump apparatus of simple construction and high capacity.

Another object of the invention is to provide a simple and economical pump apparatus for use in wells which will provide a marked increase in pumping capacity over pumps heretofore known.

According to the invention, the hollow tube is carried by a string of sucker rods and reciprocated up and down near the bottom of a well. A ball valve near the bottom of the well opens on the up stroke to provide fluid flow through the hollow rod into two pumping chambers which are sealed from each other by way of the instant unique pack-off assembly. On the down stroke, a second ball valve is opened and the first ball valve is closed to discharge fluid to a point in the well tubing above the pump apparatus for expulsion during subsequent pump reciprocations.

BRIEF DESCRIPTION OF THE DRAWING

Other objects, features and advantages of the invention, its organization, construction and operation will be best understood from the following detailed description taken in conjunction with the accompanying drawing, on which.

DESCRIPTION OF THE PREFERRED EMBODIMENT

Figure 1:
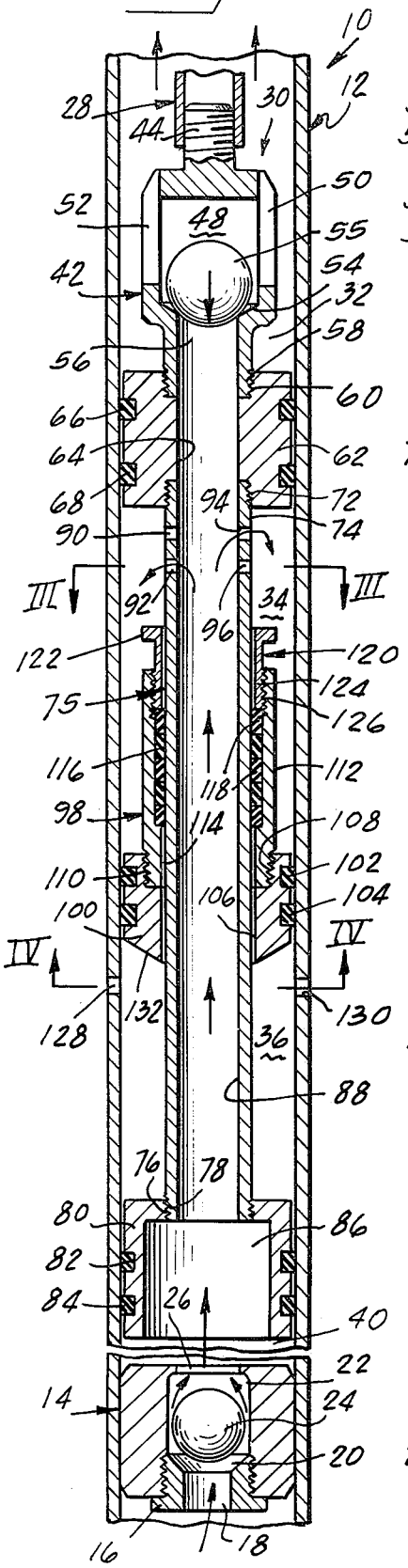
FIG. 1 is a sectional view of pump apparatus constructed in accordance with the invention, shown at the initiation of an up stroke.

Referring to the drawing, pump apparatus is generally illustrated at 10 as comprising a hollow well tubing 12 (in this case, the barrel which is in effect an integral part of the tubing) which, as is well known in the art, is normally constructed of a plurality of end-to-end connected tubes.

At or near the lower end of the tube 12, a ball valve 14 is disposed, the valve 14 including a plug 16 having a bore 18 for receiving fluid flow therethrough, a valve seat 20, a chamber 22, a ball 24, and an output passage 26.

At the upper end of the apparatus illustrated in FIG. 1, a string of sucker rods is symbolically illustrated at 28 connected to pump apparatus 30.

The pump apparatus 30 comprises structure which divides the tubing (barrel) 12 into a plurality of chambers 32, 34, 36 and 40. The chamber 32 has disposed therein and in fluid communication therewith a valve 42 which comprises a threaded stud 44 for threaded connection to the string of sucker rods 28, a body 46 having a hollow chamber 48 and a plurality of passageways 50 and 52 communicating the chamber 48 with the chamber 32, a valve seat 54, a passageway 56, and a threaded hollow portion 58 for threaded engagement with a threaded bore 60 of an upper plunger 62. The valve seat 54 is shaped to receive and fluidically seal communication between the chamber 48 and the passageway 56 by means of a ball 55.

The upper plunger 62 comprises a bore 64 in communication with the passageway 56, and a pair of seals 66 and 68 which engage and seal the plunger 62 with respect to the inner surface 70 of the tubular casing 12.

The upper plunger 62 includes a threaded bore 72 for threaded connection with one end 74 of a hollow tube 75 which includes a threaded end 76 threadedly engaging a threaded bore 78 of a lower plunger 80. The lower plunger 80 includes a hollow chamber 86 and is sealed to the inner surface 70 of the tubular casing 12 by means of a plurality of fluid seals 82 and 84. The hollow chamber 86, during pumping, forms a part of a larger chamber 40 between the lower plunger 80 and the ball valve 14. The hollow chamber 86 is in fluid communication with the upper ball valve 42 by means of the hollow interior 88 of the tube 75.

The tube 75 has, near its upper end, a plurality of transverse bores 90, 92, 94 and 96 which provide communication between the hollow interior or passageway 88 and the upper pumping chamber 34.

The upper pumping chamber 34 and the lower pumping chamber 40 (86) are sealed from each other by a pack-off assembly 98 which includes a seating member 100 having a pair of seals 102 and 104 which engage the inner surface 70 of the well casing 12, a bore 106 to receive the hollow polished tube 75, and a threaded counterbore 108 for threadedly receiving a threaded end 110 of a pack-off jacket 112.

The pack-off jacket 112 includes a first diameter bore 114 for receiving the polished tube 75, a second and larger inner diameter 116 which receives packing 118 and a threaded portion 126 which receives a threaded end 124 of a packing nut 120 which has a head 122.

The packing 118 may be a soft packing, such as square braided graphite-hemp packing or a precision metal seal packing.

Referring specifically to FIG. 1, the pump is illustrated in its extreme down position and at the initiation of an up stroke. The pumping chambers 34 and 40 have fluid drawn therein due to a low pressure condition which is caused by (1) the formation of a vacuum and (2) the existence of any hydrostatic head outside of the well bore tubing 12.

The fluid enters the pump through the lower ball valve 14 filling the lower chamber 40 (86), continues up through the hollow polished rod or tube 75 and flows through the holes 90–96 to fill the upper chamber 34.

At the end of the up stroke, the lower ball falls and seats against the valve seat 20 and one half of the pumping cycle is completed.

Next, the pump then starts on its down stroke and the fluid in the lower chamber is displaced by the lower plunger 80 and is forced up through the hollow polished rod 75. The fluid from the lower chamber is joined by the fluid being displaced from the upper chamber by the upper plunger 62, via the bores 90–96. The pressure of this combined fluid flow overcomes the pressure above the upper ball valve 42 causing the ball 55 to rise off of its seat 54 and permit fluid flow through the passage 56, through the chamber 48 and into the chamber 32 via the openings 50 and 52.

At the end of the down stroke, the upper ball valve closes to complete one pumping cycle.

Figure 2:
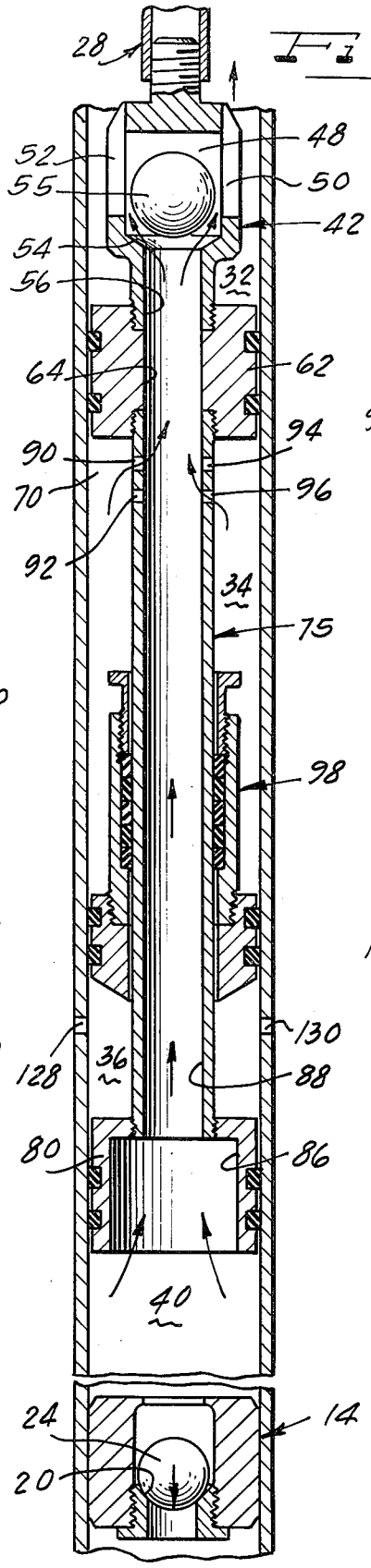
FIG. 2 is a similar sectional view to that illustrated in FIG. 1 at the initiation of, or at least during, the down stroke of the pump.
Figure 3:
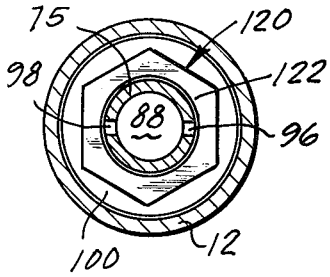
FIG. 3 is a sectional view taken substantially along the line III—III of FIG. 1.
Figure 4:
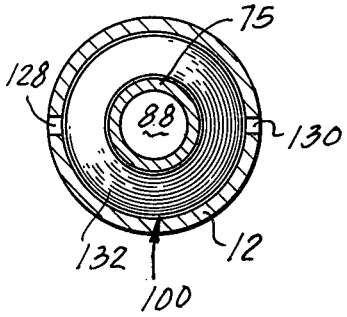
FIG. 4 is a sectional view taken substantially along the line IV—IV of FIG. 1.

Referring to FIG. 2, the apparatus of FIG. 1 is illustrated at the initiation of a down stroke showing the opening of the upper ball valve 42 and the fluid flow from the chambers 40 (86) and 34 into the chamber 32.

During assembly of the pumping apparatus, the pack-off assembly 98 is anchored in place by means of friction rings and the pack-off assembly, with the hollow polished rod 75 and the plungers 62 and 80, all in one unit, are lowered into the well tubing or casing 12 on the end of a string of sucker rods 28. This string of rods is the same as that which operates the pump and provides its up and down reciprocating action. As an example, the weight of the sucker rods usually approximates 1 pound per foot, so that a well of 500 feet deep, or deeper, as is usually the case, would utilize a sucker rod assembly having sufficient weight to force the 0.030 inch, for example, over size seating rings of the pack-off assembly into the pump barrel.

It should be noted that the tube 12 is provided with openings 128 and 130 which communicate the exterior of the well bore with the chamber 36 to provide lubrication of the lower plunger 80 and breathing of the apparatus.

It is readily apparent to those skilled in the art that pump apparatus constructed in accordance with the present invention may utilize a variety of different materials for the components of the pump structure. However, I have found that certain materials provide a suitable, sturdy and economical construction and set forth these materials in the following tabulation.

| ELEMENT | MATERIAL |
|---|---|
| Upper valve body 42 | Stainless Steel. |
| Tubular casing 12 | Steel. |
| Threaded stud 44 | Steel. |
| Upper plunger 62 | Steel. |
| Seals 66, 68 | Composition rings. |
| Alternative plunger 62 | Precision metal plunger. |
| Hollow polished rod 75 | Steel. |
| Packing nut 120 | Steel. |
| Pack-off jacket 112 | Steel. |
| Packing 118 | Graphite-hemp |
| Alternative packing 118 | Precision metal seal. |
| Seating member 100 | Steel. |
| Seating rings 102, 104 | Composition (canvas and rubber). |
| Lower plunger 80 | Steel. |
| Alternate lower plunger 80 | Precision metal plunger. |
| Lower ball valve 14 | Stainless steel. |

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Well pump apparatus for connection to and operation by a reciprocating string of sucker rods which extend downwardly into a well tubing, comprising: said tubing constituting an outer pump casing;

a one-way first valve mounted within said tubing permitting upward fluid flow;

a hollow member of lesser outer diameter than the inner diameter of said tubing disposed within said tubing and connected to said string of sucker rods for reciprocation;

lower and upper plungers carried by said hollow member above said first valve in spaced relation and in sealed sliding engagement with said tubing, each of said plungers having a fluid passageway therein in a fluid communication path with said hollow member and said first valve;

a one-way second valve mounted for reciprocation with said hollow member and operable to provide communication between the fluid communication path and the interior of said tubing above said upper plunger; and a pack-off assembly anchored in a forced fit in sealed relation within and with respect to the inner surface of said tubing, said pack-off assembly forced into its anchored position by said upper piston and removed from its anchored position by said lower piston in response to a downward force and an upward force, respectively, applied to the sucker rods, said pack-off assembly including chamber dividing means receiving said hollow member in sealed sliding engagement between said upper and lower plungers to form upper and lower pumping chambers of equal diameter, said hollow member including fluid passage means above said pack-off assembly providing communication of the fluid communication path and said upper chamber, whereby during an up stroke fluid is drawn through said first valve into said lower chamber and via said fluid communication path and said fluid passage means into said upper chamber and during a down stroke fluid is expelled via said second valve from said lower chamber via said fluid communication path and from said upper chamber via said fluid passage means and said fluid communication path upwardly through said tubing.

2. The well pump apparatus of claim 1, wherein said pack-off assembly comprises:

a first member having a bore receiving said hollow member therethrough;

first sealing means fixing and sealing said first member with the inner surface of said tubing; and second sealing means slidingly sealing said hollow member and said first member.

3. The well pump apparatus of claim 2, wherein said second sealing means comprises:

a tube extending axially from said first member and having a threaded portion;

packing material about said hollow member within said tube; and a packing nut threadedly engaging said threaded portion for retaining the packing material and adjusting the sealing thereof.

4. The well pump apparatus of claim 2, wherein:

said first member includes a threaded portion in said bore; and said second sealing means comprises a tube having an outside threaded portion threadedly engaging said threaded portion of said bore, and an inside threaded portion, a packing portion having an inner diameter greater than the outer diameter of said hollow member, packing material about said hollow member within said packing portion, and a threaded packing nut having a bore receiving said hollow member, said packing nut engaging said inner threaded portion of said tube to retain said packing material.

5. The well apparatus of claim 1, comprising packing material slidingly sealing said hollow member and said chamber dividing means.

6. The well apparatus of claim 5, wherein said packing material comprises graphite-hemp packing.

7. The well apparatus of claim 5, wherein said packing material comprises a precision metal seal packing.

* * * * *